United States Patent [19]

Shinkawa et al.

[11] 4,421,152

[45] Dec. 20, 1983

[54] APPARATUS FOR PRECISION CASTING

[75] Inventors: Tsutomu Shinkawa, Itami; Akihide Yoshino, Osaka; Hitoshi Konishi, Ibaragi; Yoshiaki Komuro, Nishinomiya; Satoshi Hamada, Suita; Saburo Okumura, Amagasaki, all of Japan

[73] Assignee: Sansha Electric Mfg. Co., Ltd., Osaka, Japan

[21] Appl. No.: 239,470

[22] Filed: Mar. 2, 1981

[30] Foreign Application Priority Data

Mar. 5, 1980 [JP] Japan ..... 55-28270

[51] Int. Cl.[3] ..... B22D 18/06; B22D 21/02; B22D 27/13

[52] U.S. Cl. ..... 164/258; 164/250.1; 164/253; 164/259

[58] Field of Search ..... 164/61–63, 164/65, 66.1, 68.1, 136, 137, 250.1, 253, 254, 256, 258, 259, 284

[56] References Cited

U.S. PATENT DOCUMENTS

| | | | |
|---|---|---|---|
| 1,469,282 | 10/1923 | Storz | 164/62 X |
| 3,677,332 | 7/1972 | Smiernow | 164/62 X |
| 3,712,364 | 1/1973 | Daniel et al. | 164/63 X |
| 3,955,612 | 5/1976 | Schultheiss | 164/62 |
| 4,150,707 | 4/1979 | Emerick | 164/284 X |
| 4,254,817 | 3/1981 | Kidowaki et al. | 164/259 X |

FOREIGN PATENT DOCUMENTS

| | | | |
|---|---|---|---|
| 51-38231 | 9/1976 | Japan . | |
| 384783 | 2/1965 | Switzerland | 164/65 |

*Primary Examiner*—Gus T. Hampilos
*Assistant Examiner*—J. Reed Batten, Jr.
*Attorney, Agent, or Firm*—Eugene E. Geoffrey, Jr.

[57] ABSTRACT

A precision casting device especially suitable for dental use, which includes melting and casting chambers supported by a frame such that they are arranged coaxially up and down in the frame under a normal operating state and can be drawn horizontally out of the frame during service time in order to facilitate access to the interiors of them, and which is provided with evacuating apparatus and an inert gas supply and can carry out the casting process in which a casting material is molten in an inert atmosphere, the molten material is then supplied to a mold in a vacuum state and, therafter, casting is effected under a pressure of inert atmosphere.

5 Claims, 4 Drawing Figures

APPARATUS FOR PRECISION CASTING

This invention relates to an improved casting device for precision casting, especially suitable for dental use.

In order to prevent undesirable oxidation and contamination in precision casting, it was the general practice to carry out melting and casting steps in a vacuum or reduced pressure condition. However, the vacuum casting system used to suffer from heavy evaporation and deposition of molten material onto the inner wall of the device, which would not only require troublesome cleaning work but also result in a loss of expensive material. In order to avoid this disadvantage of the vacuum casting system, it was proposed to carry out the above steps in an inert atmosphere. However, this method also exhibited such a disadvantage that the inert gas remaining in the mold cavity might result in blowholes and rough casting skins which were fatal for dental use. Moreover, a common disadvantage of the abovementioned methods was that the molten metal might not fill every nook and corner of the mold cavity due to its surface tension. It was considered that this problem of surface tension could be overcome by means of riser or sink head but it was impossible in practice since it was difficult to make the height of the riser sufficiently high in such a small-sized mold.

Japanese Patent Publication No. 52-1235 issued Jan. 13, 1977 proposed an improved method and device for casting precision products, which could solve the abovementioned problems. In this method, a crucible containing a casting material and a mold are put in an air-tight chamber, an inert gas is first introduced in the chamber and the material is molten in the inert gas atmosphere. Then, the chamber is evacuated and the molten material is poured into the mold. Just after pouring the melt, the inert gas is again supplied to the chamber, thereby pushing the melt into the mold by the gas pressure. A similar process is also disclosed by Japanese Utility Model Publication No. 51-38231 issued Sept. 18, 1976.

Although the problems of vacuum casting as aforementioned have been removed by the processes of the above publications, another problem yet remained in the casting devices. In the prior art devices for vacuum casting, it has been the general practice to place a crucible and a mold in an air-tight sealed chamber and to execute both melting and casting processes within this chamber. In such prior art devices, assembling and disassembling of the vacuum chamber, exchange of the crucible and mold, and cleaning of the chamber were troublesome and time-consuming work.

Accordingly, an object of this invention is to provide an improved precision casting device having a processing chamber which is easily disassembled and reassembled to facilitate access to the crucible and mold.

In a device according to this invention, the processing chamber is divided into two chambers, that is, melting and casting chambers. These chambers are supported individually by a supporting frame in a vertically coaxial relationship. As a feature of this invention, the casting chamber is fitted in a cup-shaped cavity of a holding member which is supported by the frame, so that it can be pushed upwards by forcing a gas into the cavity. The rise of the casting chamber results in contact of both the melting and casting chambers to form a single chamber.

These and other objects and features of this invention will be described in more detail hereinunder with reference to the accompanying drawings.

IN THE DRAWINGS

FIG. 4 is a diagram representing a pressure in the processing chamber of the device of FIGS. 1 and 2 with respect to time during a cycle of illustrative operation.

Throughout the drawings, like reference numerals are used to denote corresponding structural components.

Figure 1:
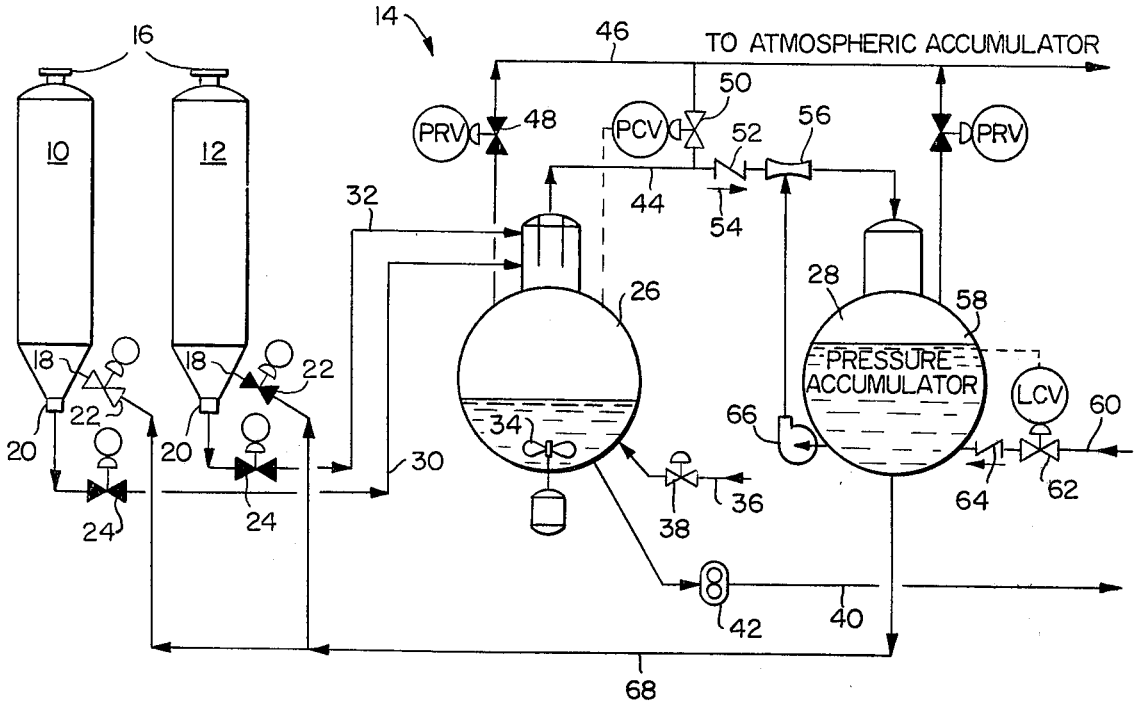
FIG. 1 is a cross-sectional front view representing an embodiment of the device according to this invention.
Figure 2:
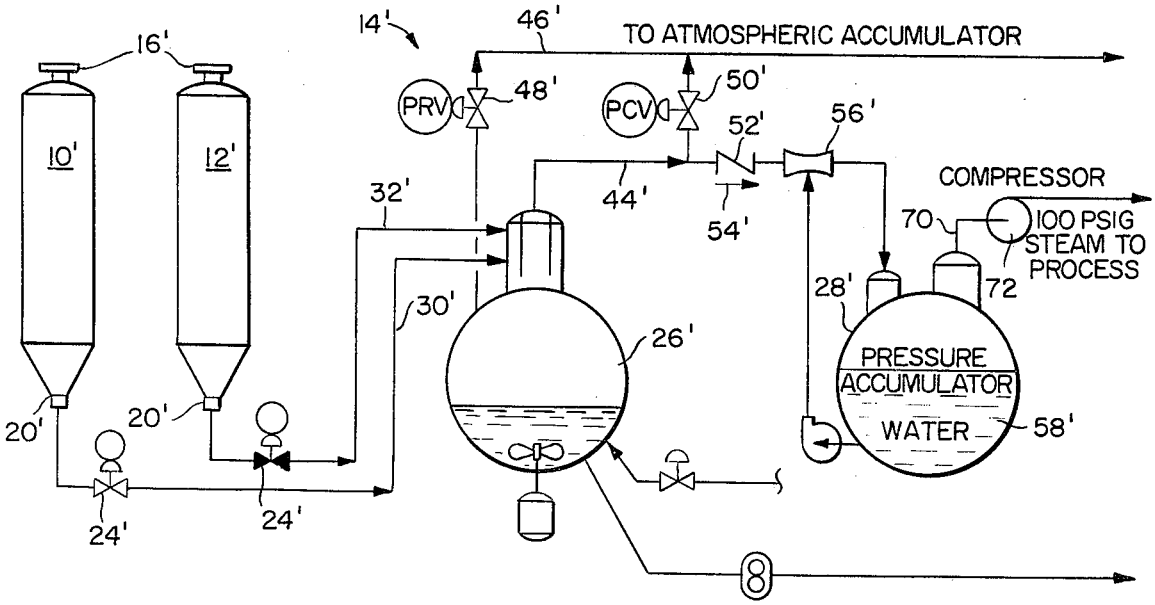
FIG. 2 is a side elevational view of the device of FIG. 1.

FIGS. 1 and 2 show a preferred embodiment of the precision casting device of this invention which includes a supporting frame denoted generally by the numeral 1. The frame 1 has a top wall 2 and a base wall 4 connected rigidly by four corner posts 6. Two pairs of horizontal U-section rails 8 and 10 are fixed to the corner posts 6 in vertically spaced parallel relationship with their back ends extending beyond the frame 1 as shown in FIG. 2 for the purpose described later. Two pairs of carriages 14 and 16 are supported by the rails 8 and 10, respectively, through rollers 12 so as to be movable horizontally along the rails.

A cup-shaped cylinder block 18 having a bottom wall and a top flange 20 is supported on the lower carriages 14 through springs 22 which surround four guide posts 24, respectively. The guide posts 24 are fixed vertically to the carriages 14 and retained loosely in corresponding holes (as shown by dashed lines in FIG. 2) in the flange 20 to allow some vertical movement of the block 18. The amount of compressive deflection of the springs 22 from their balanced position is selected to be greater than the balanced gap between the bottom wall of the cylinder block 18 and the base wall 4 so as to allow forced contact therebetween as described later. It should be noted that the springs 22 may be substituted with suitable elastic blocks such as of rubber or plastic so long as the above condition is satisfied. A gas inlet port D is provided at the lower portion of the side wall of the cylinder block 18.

A cup-shaped cylindrical casting chamber 26 is disposed in the inner cavity of the cylinder block 18 so as to be movable vertically with respect to the block 18. O-rings 28 are disposed between the block 18 and the chamber 26 in order to provide a seal between the chamber and block. A mold 30 made of suitable material such as plaster and having a mold cavity 32 and a pouring gate 34 is located in the casting chamber 26 and surrounded by a thermal insulator material 36.

A cylindrical melting chamber 38 having a flange 40 is supported on the upper carriages 16 through four guide posts 42 which are fixed vertically to the carriage 16 and retained loosely in corresponding holes (as shown by dashed lines in FIG. 2) in the flange 40 to allow vertical movement of the chamber 38. The chamber 38 has a bottom plate 44 having a central aperture and some through-holes. An O-ring 46 is disposed on the lower face of the side wall of the melting chamber 38, which faces the upper face of the side wall of the casting chamber 26, to insure air-tightness therebetween.

The central aperture of the bottom plate 44 of the melting chamber receives the lower end of a crucible 48 containing a casting material 50. The crucible 48 is divided into two similar segments along a vertical plane as shown and the central aperture of the bottom plate 44 holds these segments at their lower ends together so that they do not come apart from each other. The crucible 48 is also supported at the upper portion by a supporting member 52 so that the segments are held together at their upper ends. The supporting member 52 is arranged to be movable upwardly by means of an air cylinder 54 disposed in the chamber 38. When the crucible 48 is lifted by the supporting member 52 upon actuation of the air cylinder 54, the lower end of the crucible is released from the bottom plate 44 and the lower ends of the segments come apart from each other thereby releasing the molten content of the crucible to flow down into the mold 30. The crucible 48 is surrounded by a heating element 56, such as a radio frequency coil, for melting the casting material 50. An air inlet port C is formed in the side wall of the chamber 38 for driving the air cylinder 54.

Though the crucible 48 is shown and described as divided into two segments as a preferred embodiment, it should be noted that it may be divided into three or more segments if necessary. Moreover, instead of the divided crucible, a prior art crucible as disclosed by the aforementioned Japanese publications may be used with an appropriate melt discharging mechanism.

The top wall 2 of the supporting frame 1 has a central window 58 which is closed, air-tightly, with a glass plate 60 by the aid of an O-ring 62 and a fixture member 64 to provide means for observing the interior of the crucible 48. The top wall 2 is also provided with gas inlet ports A and B communicating with the melting chamber 38. An O-ring 66 is disposed on the lower face of the top wall 2 facing the upper face of the side wall of the melting chamber 38 so as to insure an air-tight seal therebetween.

Figure 3:
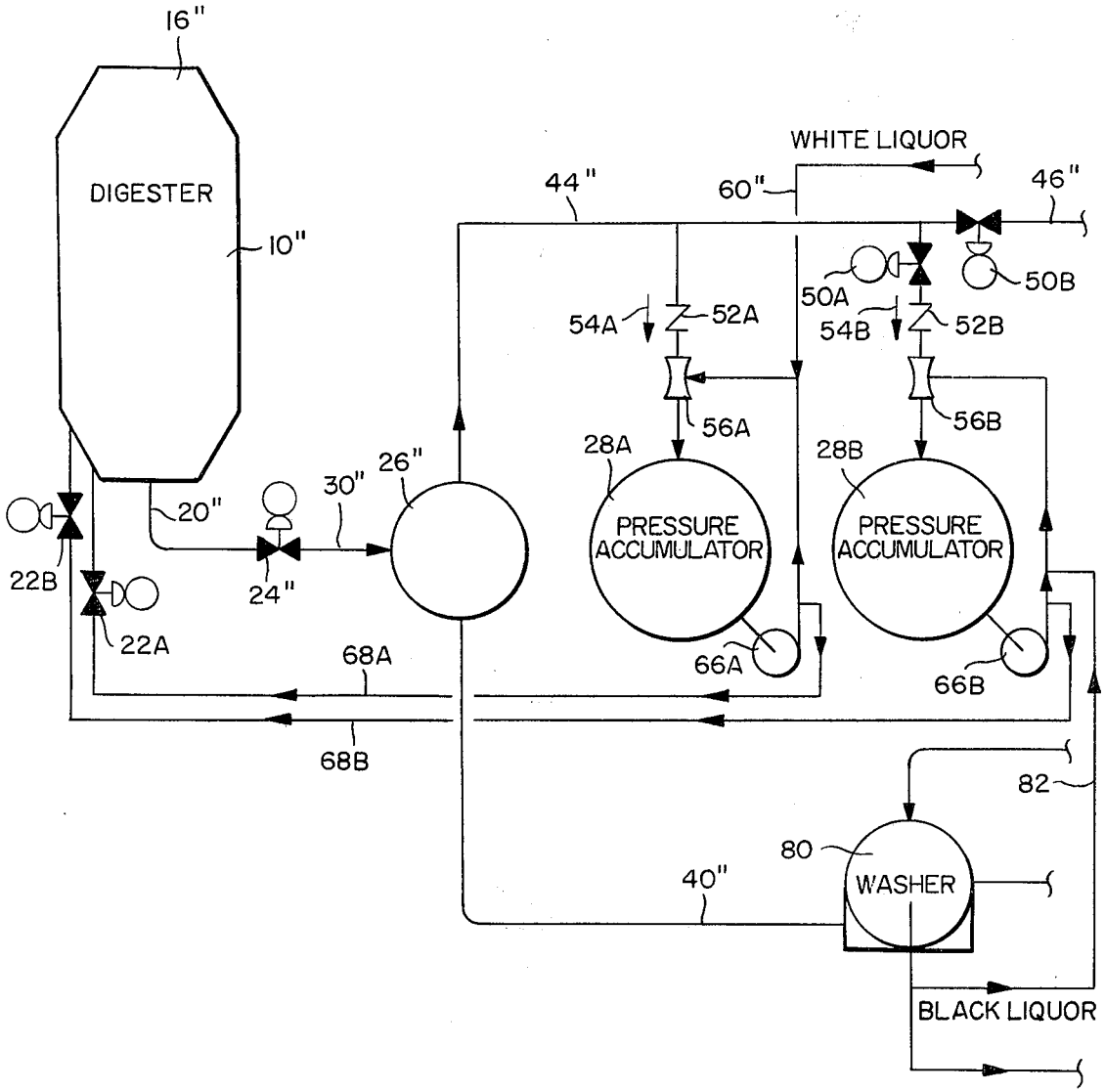
FIG. 3 is a schematic view representing an embodiment of an evacuating and gas feeding system of the device of FIGS. 1 and 2.

Now, the evacuation and gas feeding system of the device of FIGS. 1 and 2 will be described with reference to FIGS. 1 to 3. The port A of the top wall 2 is connected through a pipe line 68 having a stop valve 70 to a suitable gas source 72, such as a gas bottle, containing an inert gas, such as nitrogen or argon, which is inactive to the molten casting material. The port B in the top wall 2 is connected to the external air through a pipe line 74 having a filter 76 and a stop valve 78. The port C in the side wall of the melting chamber 38 is connected also to the external air through a pipe line 80 having a stop valve 82 and a suitable vacuum pump 84. A point 86 of the pipe line 74 between the filter 76 and the valve 78 is connected through a stop valve 88 to a point 90 of the pipe line 80 between the valve 82 and the pump 84. The port D in the side wall of the cylinder block 18 is connected through a pipe line 92 having a stop valve 94 to the point 90 of the pipe line 80 and also connected through another pipe line 96 having a stop valve 98, a flow rate regulator valve 100, a pressure regulator 102, a filter 104 and an air compressor 106 in that order to the external air. The port C is also connected through a pipe line 108 having a stop valve 110 and a flow rate regulator valve 112 to a point 114 of the pipe line 96 between the regulator valve 100 and the pressure regulator 102.

As a variation of this piping system, the pipe line 96 may be connected to a suitable high pressure gas source, such as a gas bottle, containing inert gas or air, instead of the air compressor 106.

Now, the operation of the device will be described starting at the status of the various components as shown in FIGS. 1 and 2, wherein all of the stop valves 70, 78, 82, 88, 94, 98 and 110 are closed and the vacuum pump 84 and the air compressor 106 are operated.

First, the stop valve 98 is opened to force the external air into the inner cavity of the cylinder block 18 through the pipe line 96 and the port D. The forced air in the cavity will push the casting chamber 26 upwardly and into contact with the melting chamber 38. If the air is fed continuously into the cavity, the casting chamber 26 will push the melting chamber 38 upwardly into contact with the top wall 2. If the air is further forced into the cavity of the cylinder block 18, then the cylinder block 18 will come down until its bottom comes into contact with the base wall 4 of the frame 1 with compression of the springs 22. Thus, the cylinder block 18, casting chamber 26 and melting chamber 38 are rigidly supported between the top and base walls 2 and 4 of the frame 1 and the inner cavities of the chambers 26 and 38 form an air-tight processing chamber containing the crucible 48 and the mold 30.

Next, the stop valve 88 is opened to evacuate the processing chamber through the port B, pipe lines 74 and 80 and vacuum pump 84 up to the degree of vacuum of about 60 Torr. as shown by a point 116 in FIG. 4. The valve 88 is then closed and the stop valve 70 is opened to supply the inert gas from the gas source 72 through the pipe line 68 and the port A into the processing chamber. The gas pressure in the chamber is preferably about 0.3 kilograms per square centimeter. Then, electric energy is supplied to the heating element 56 to heat and melt the casting material 50 in the crucible 48. During the heating step, the stop valve 78 is opened to drive unwanted gases exhausted from the casting material 50, crucible 48, thermal insulator material 36 and the like out of the chamber and the gas pressure in the chamber is preferably maintained at about 0.3 kilograms per square centimeter, as shown by a horizontal line 118 in FIG. 4, by adjusting the valve 70.

When the casting material 50 is completely molten in the crucible 48, the valve 70 is closed to stop feeding the inert gas and the valve 88 is opened to evacuate again the processing chamber up to about 160 Torr. as shown by a point 120 in FIG. 4, in order to remove the inert gas from the interior of the mold 30. Then, the stop valve 110 is opened to supply air from the port C into the air cylinder 54 to actuate it to raise the supporting member 52. Thus, the crucible 48 is opened at the lower end as aforementioned to discharge the contents into the mold 30. Just after the melt comes in the pouring gate 34 of the mold 30, the valve 88 is closed to stop evacuation and the valve 70 is opened again to supply the inert gas into the chamber to raise the pressure in the chamber up to about 3 atmospheres as shown by a horizontal line 122 in FIG. 4. With this increased pressure, the molten material at the pouring gate 34 is forced into the mold cavity 32 to completely fill it.

It is preferred to control the flow rate regulator valve 100 to maintain the pressure in the cylinder block 18 a little higher than the pressure in the processing chamber so as to insure the air-tightness of the chamber and, at the same time, to serve the function of a safety valve for accidental excessive high pressure in the chamber.

After the melt in the mold 30 solidifies completely, the valve 70 is closed and the valve 78 is opened to allow the inert gas to flow out of the processing chamber, thereby rendering the pressure in the chamber the same as the external atmospheric pressure. Then, the valve 98 is closed to stop forced air supply and the valves 94 and 88 are opened to allow the air to flow out of the cylinder block 18. This results in lowering of the melting and casting chambers 38 and 26 by their own weights to the mutually separated state as shown in FIGS. 1 and 2. In this state, the chambers 26 and 38 can be drawn out of the frame 1 individually along the rails 8 and 10, respectively, to readily execute cleaning and reloading of the crucible 48 and unloading or exchange of the mold 30.

It should be noted that the above description has been made in conjunction with one embodiment for illustrative purposes only and various modifications and changes can be made without departing from the scope of this invention by those skilled in the art. For example, arc discharge may be utilized for melting the material 50 instead of radio frequency or resistive heating technique. Electromagnetic or other mechanisms may be utilized for raising the supporting member 52 instead of the air cylinder 54.

What is claimed is:

1. A casting device comprising a frame including spaced top and bottom walls and at least one open side, a melting chamber including a crucible within said frame and spaced from the top wall thereof, heating means for heating said crucible to melt the contents therein and means for discharging melted contents from the bottom of said crucible, a casting section containing a mold disposed beneath said melting chamber, supporting means carried by said frame for supportingg said melting chamber and casting section for individual vertical movement within said frame, fluid actuated means operable between said bottom wall and said casting section to move said mold upwardly and into contact with said melting chamber and in turn move said melting chamber upwardly into contact with the top wall of said frame prior to operation of said heating means and means in said top wall for feeding a gas to said melting chamber during operation of said heating means, said open side providing ready access to said melting chamber and casting section for individual removal from said frame, said casting section including a cup-shaped cylinder block mounted for vertical displacement, a casting chamber carrying said mold disposed within said cylinder block and movable vertically relative thereto and said fluid actuated means includes a fluid inlet port in said cylinder block and beneath said casting section whereby the introduction of a fluid into said port in said cylinder block forces the casting chamber upwardly against the melting chamber, the melting chamber uppwardly against said top wall and said cylinder block downwardly against said bottom wall.

2. A casting device according to claim 1 including means for evacuating said melting chamber and mold when said contents are molten.

3. A casting device according to claim 2 wherein said crucible includes a plurality of segments formed by dividing said crucible along at least one vertical plane, and said discharging means include a first section for gathering said segments in unity and supporting them at their upper portions, a second section for gathering said segments in unity and holding them at their lower portions to prevent them from coming apart from each other, and means for releasing the hold of said second section to open the lower ends of said segments, thereby discharging the molten material downwardly.

4. A casting device comprising a frame having top and bottom walls and vertical supports secured to and disposed between said walls for holding them in spaced parallel relationship and providing at least one open side, upper and lower pairs of horizontally disposed rails carried by said supports, a melting chamber having upper and lower surfaces, a first carriage engaging said upper pair of rails and movable into and out of said frame, said first carriage including means for engaging and supporting said melting chamber and permitting vertical displacement of the melting chamber relative to said first carriage, a crucible including heating means disposed within said melting chamber, means for discharging melted contents of the crucible downwardly, a second carriage engaging said lower pair of rails, a casting section including first and second members and a mold carried by said second carriage and disposed between the melting chamber and said bottom wall, said second member being slidably disposed in said first member and having a cavity opening upwardly and containing said mold and said first member being vertically movable relative to said second carriage, means for feeding a gas into said melting chamber and means for feeding a gas between said first and second members to urge said second member upwardly against the lower surface of said melting chamber, the upper surface of said melting chamber against the top wall and the lower surface of said first member downwardly against said bottom wall to form air-tight seals between the upper surface of the melting chamber and said top wall and the upper surface of said mold and the lower surface of said melting chamber.

5. A casting device according to claim 4 wherein said crucible includes a plurality of segments formed by dividing said crucible along at least one vertical plane, and said discharging means include a first segment for gathering said segments in unity and supporting them at their upper portions, a second section for gathering said segments in unity and holding them at their lower portions to prevent them from coming apart from each other, and means for releasing the hold of said second section to open the lower ends of said segments, thereby discharging the molten material downwardly.

* * * * *